United States Patent [19]

Childs et al.

[11] 4,352,334

[45] Oct. 5, 1982

[54] METHOD AND APPARATUS FOR STITCHING MATERIAL ALONG A CURVE

[76] Inventors: William R. Childs, 77 S. Adams, Apt. No. 1504, Denver, Colo. 80209; Randall Melton, 24150 E. 160th Ave., Brighton, Colo. 80601

[21] Appl. No.: 289,825

[22] Filed: Aug. 3, 1981

[51] Int. Cl.[3] ..... D05C 5/02

[52] U.S. Cl. ..... 112/266.1; 112/103

[58] Field of Search ..... 112/266.1, 102, 103, 112/121.12, 158 E, 308, 309

[56] References Cited

U.S. PATENT DOCUMENTS

| | | | |
|---|---|---|---|
| 3,059,599 | 10/1962 | Taketomi | 112/102 |
| 3,592,152 | 7/1971 | Shimada et al. | 112/102 |
| 3,750,186 | 7/1973 | Sakamoto | 112/102 X |
| 4,142,473 | 3/1979 | Itoh | 112/158 E |
| 4,220,101 | 9/1980 | Nanai et al. | 112/158 E |
| 4,309,950 | 1/1982 | Franklin | 112/103 |

*Primary Examiner*—Peter P. Nerbun

*Attorney, Agent, or Firm*—Sheridan, Ross & McIntosh

[57] ABSTRACT

A method and an apparatus are provided for stitching selected characters on material along a desired arc. A plurality of characters are stored in a character memory. The character memory communicates with a microprocessor which controls the operation of the apparatus. The microprocessor executes predetermined instructions stored in an EPROM while a RAM temporarily stores data required for proper apparatus operation. The characters selected for stitching along the arc are provided to the apparatus by the user. The radius of the arc along which the selected characters are to be stitched is also provided to the apparatus by the user. Each selected character has a reference position and is defined by a plurality of stitch locations having x, y coordinates. The mircroprocessor, in conjunction with the EPROM and RAM, rotates the stitch locations of the selected characters from the reference position to a rotated position using known and determined parameters of the selected characters and the inputted radius. By means of microprocessor control, stepping motors are activated to move a carriage assembly in x and y directions using the rotated stitch locations. The material to be stitched is connected to the carriage assembly and moves therewith. During non-movement of the carriage assembly, the material is stitched using the given and determined rotated stitch locations so that the selected characters are stitched on the material along the desired arc.

7 Claims, 21 Drawing Figures

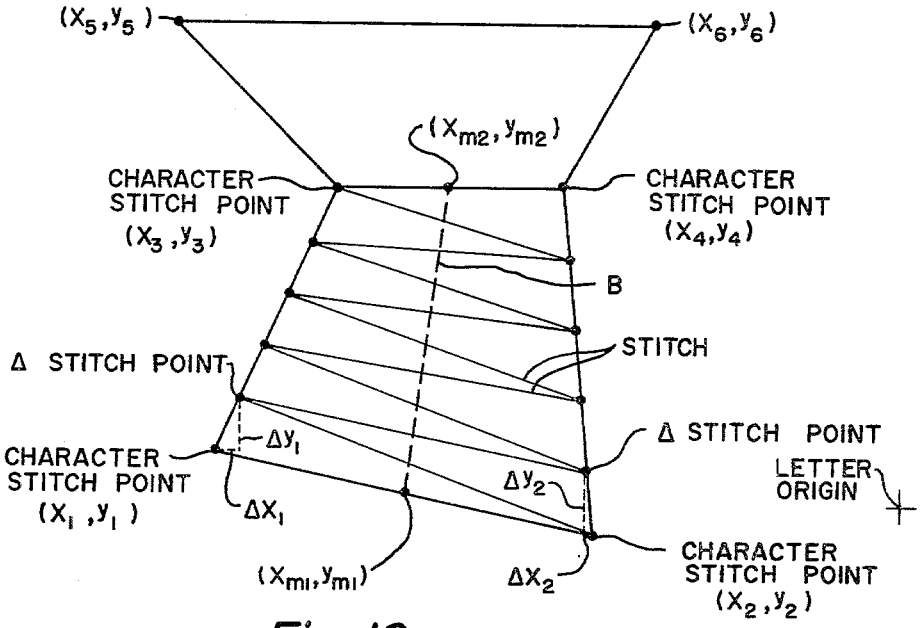

*Fig.-10a*

IN STITCHING ALONG AN ARC REDEFINE CHARACTER STITCH POINTS WITH REFERENCE TO ARC ORIGIN $$x_{m1} = \frac{x_1 + x_2}{2} \qquad x_{m2} = \frac{x_3 + x_4}{2}$$

$$y_{m1} = \frac{y_1 + y_2}{2} \qquad y_{m2} = \frac{y_3 + y_4}{2}$$

$$B = \sqrt{(x_{m2} - x_{m1})^2 + (y_{m2} - y_{m1})^2}$$

*Fig.-10b*

$$\Delta x_1 = \frac{x_3 - x_1}{B \times \text{STITCH DENSITY}}, \quad \Delta y_1 = \frac{y_3 - y_1}{B \times \text{STITCH DENSITY}}$$

$$\Delta x_2 = \frac{x_4 - x_2}{B \times \text{STITCH DENSITY}}, \quad \Delta y_2 = \frac{y_4 - y_2}{B \times \text{STITCH DENSITY}}$$

COMBINE $(\Delta x_1, \Delta y_1)$ OR $(\Delta x_2, \Delta y_2)$ WITH A PREVIOUS DELTA OR CHARACTER STITCH POINT TO DETERMINE X,Y COORDINATES FOR NEXT DELTA STITCH POINT WITH REFERENCE TO THE ARC ORIGIN DETERMINE MAGNITUDE OF CHANGE IN X,Y DIRECTIONS BETWEEN SUCCEEDING STITCH POINTS FOR USE IN MOVING CARRIAGE ASSEMBLY

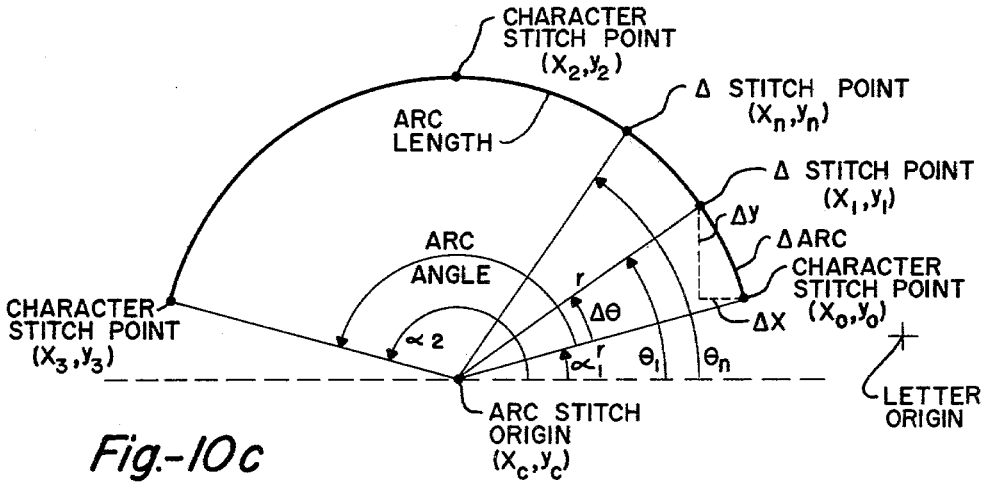

Fig.-10c

NORMALIZE $(X_0,y_0),(X_2,y_2),(X_3,y_3)$ WITH $(X_0,y_0)=(0,0)$

DETERMINE $(X_c,y_c)$, r USING NORMALIZED CHARACTER STITCH POINTS $(X_0,y_0),(X_2,y_2),(X_3,y_3)$ $$\alpha_1 = \text{ARCTAN}\left(\frac{y_0 - y_c}{X_0 - X_c}\right)$$

$$\alpha_2 = \text{ARCTAN}\left(\frac{y_3 - y_c}{X_3 - X_c}\right)$$

$$\text{ARC ANGLE} = \alpha_2 - \alpha_1$$

$$\frac{\text{ARC LENGTH}}{\text{ARC ANGLE}} = \frac{2\pi r}{360°}$$

$$\Delta\text{ARC} = \frac{1}{\text{STITCH DENSITY}}$$

$$\frac{\Delta\Theta}{\text{ARC ANGLE}} = \frac{\Delta\text{ARC}}{\text{ARC LENGTH}}$$

$X_n = r\cos(\Theta_n)$ , $y_n = r\sin(\Theta_n)$ $\Theta_n = \Theta_{n-1} + \Delta\Theta$ , $\Theta_1 = \alpha_1 + \Delta\Theta$ $(X_n,y_n)$ DEFINED WITH REFERENCE TO ARC STITCH ORIGIN $(X_c,y_c)$ REDEFINE $(X_n,y_n)$ WITH REFERENCE TO THE ARC ORIGIN FROM THE ARC STITCH ORIGIN $(X_c,y_c)$

Fig.-10d

Fig.-10f

DETERMINE $(X_{mo}, y_{mo})$ USING GIVEN $(X_{io}, y_{io}), (X_{oo}, y_{oo})$ AND $(X_{mf}, y_{mf})$ USING GIVEN $(X_4, y_4), (X_5, y_5)$ WITH REFERENCE TO ARC ORIGIN

NORMALIZE $(X_{mo}, y_{mo}), (X_3, y_3), (X_{mf}, y_{mf})$ WITH $(X_{mo}, y_{mo}) = (0,0)$

DETERMINE $(X_c, y_c), r$ USING GIVEN AND DETERMINED POINTS $(X_{mo}, y_{mo}), (X_3, y_3), (X_{mf}, y_{mf})$

DETERMINE ARC ANGLE, ARC LENGTH, $\Delta$ ARC, $\Delta\theta$ USING STEPS OF FIG. 10d FOR MID CURVE $$\alpha_o = f\left((X_c, y_c), (X_{mo}, y_{mo}), (X_{oo}, y_{oo})\right)$$

$$\alpha_f = f\left((X_c, y_c), (X_{mf}, y_{mf}), (X_4, y_4)\right)$$

N = ARC LENGTH x STITCH DENSITY = TOTAL NUMBER OF $\Delta$ARC'S $$\alpha_n = \alpha_o + \left[(\alpha_f - \alpha_o)/\boxed{N}\right] \times n$$

$$\theta_n = \Delta\theta \times n + \theta_o$$

$$\theta_o = \text{ARCTAN}\left((y_{mo} - y_c)/(X_{mo} - X_c)\right)$$

$$\text{DISTANCE DIFERENCE} = \sqrt{(X_5 - X_4)^2 + (y_5 - y_4)^2} - \sqrt{(X_{oo} - X_{io})^2 + (y_{oo} - y_{io})^2}$$

$$\frac{\Delta\ \text{DISTANCE}}{\text{STITCH}} = \frac{\text{DISTANCE DIFFERENCE}}{\text{STITCH DENSITY} \times \text{MID ARC LENGTH}}$$

$$\Delta r_n = \Delta r_{n-1} + \frac{\Delta\ \text{DISTANCE / STITCH}}{2}$$

$$X_{on} = \Delta r_n \cos(\theta_n + \alpha_n)$$
$$y_{on} = \Delta r_n \sin(\theta_n + \alpha_n)$$

$(X_{on}, y_{on})$ DEFINED WITH REFERENCE TO $(X_{mn}, y_{mn})$ AS AN ORIGIN POINT

REDEFINE $(X_{on}, y_{on})$ WITH REFERENCE TO CURVED COLUMN STITCH ORIGIN $(X_c, y_c)$ FROM $(X_{mn}, y_{mn})$

REDEFINE $(X_{on}, y_{on})$ WITH REFERENCE TO ARC ORIGIN FROM CURVED COLUMN STITCH ORIGIN $(X_c, y_c)$

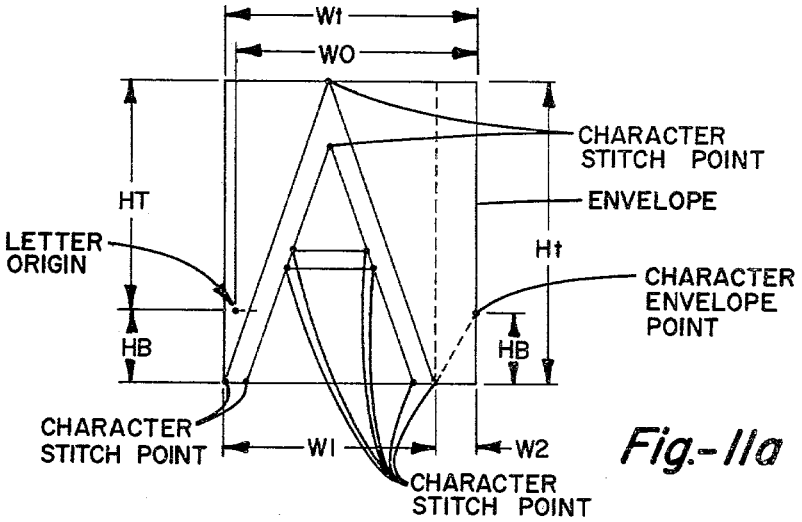

Fig.-11a

Wt = THE TOTAL WIDTH OF THE LETTER ENVELOPE
Ht = THE TOTAL HEIGHT OF THE LETTER ENVELOPE
HT = THE DISTANCE FROM THE ORIGIN TO THE TOP OF THE LETTER ENVELOPE
HB = THE DISTANCE FROM THE ORIGIN TO THE BOTTOM OF THE LETTER ENVELOPE
W1 = VISABLE WIDTH OF LETTER
W2 = NEEDLE UP DISTANCE FROM VISABLE EDGE OF LETTER TO RIGHT EDGE OF THE LETTER ENVELOPE
WO = THE DISTANCE FROM THE LETTER ORIGIN TO THE RIGHT EDGE OF THE LETTER ENVELOPE

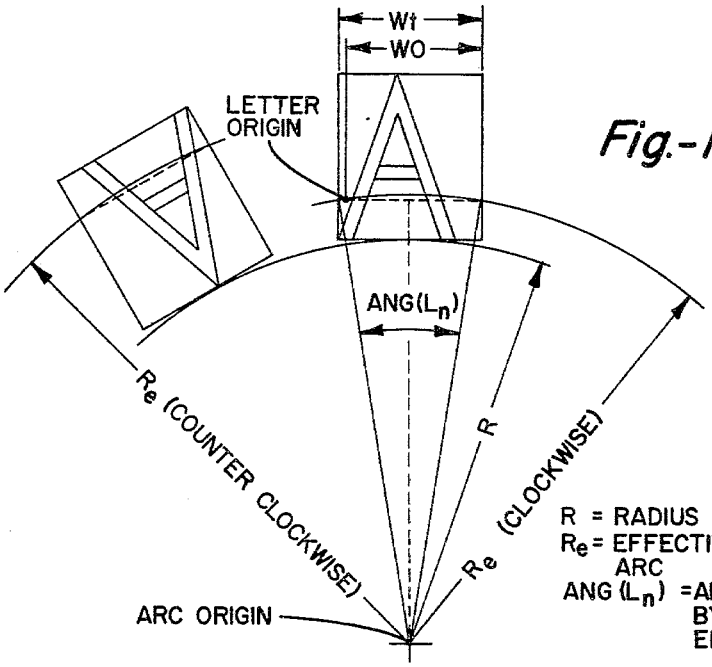

Fig.-11b

R = RADIUS OF CIRCULAR ARC
$R_e$ = EFFECTIVE RADIUS OF ARC
ANG ($L_n$) = ANGLE SUBTENDED BY LETTER (n) ENVELOPE

1. ORIGIN OF FIRST LETTER.
2. RIGHT EDGE OF FIRST LETTER ENVELOPE; ORIGIN OF SECOND LETTER.
3. RIGHT EDGE OF SECOND LETTER ENVELOPE; ORIGIN OF LAST LETTER.
4. RIGHT EDGE OF LAST LETTER ENVELOPE.

Fig.-11d
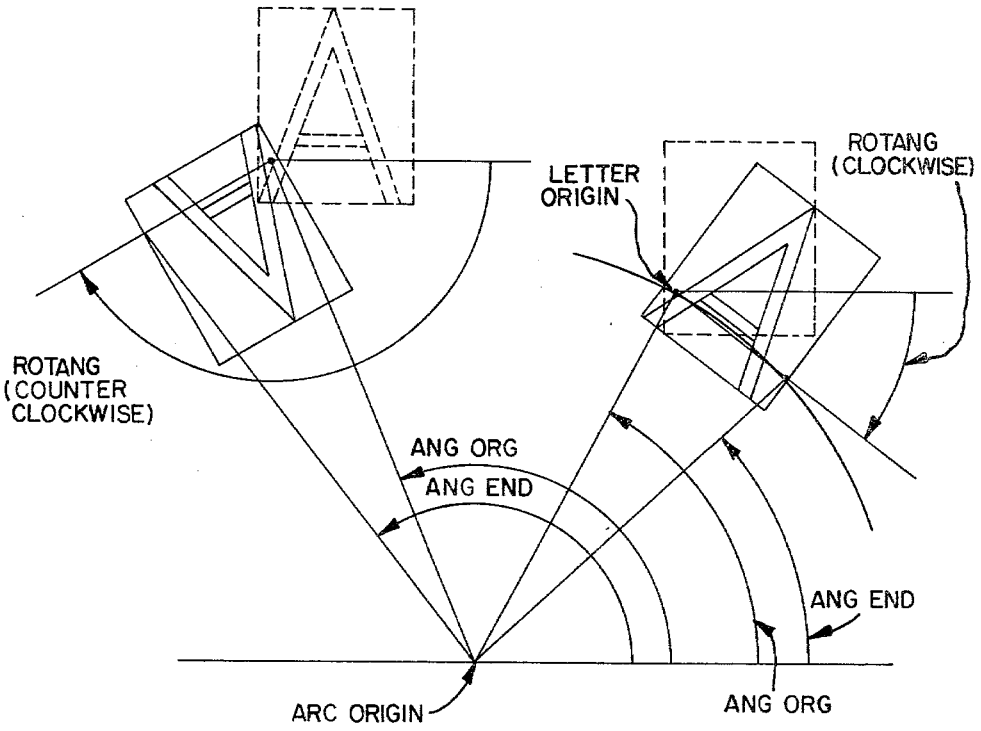
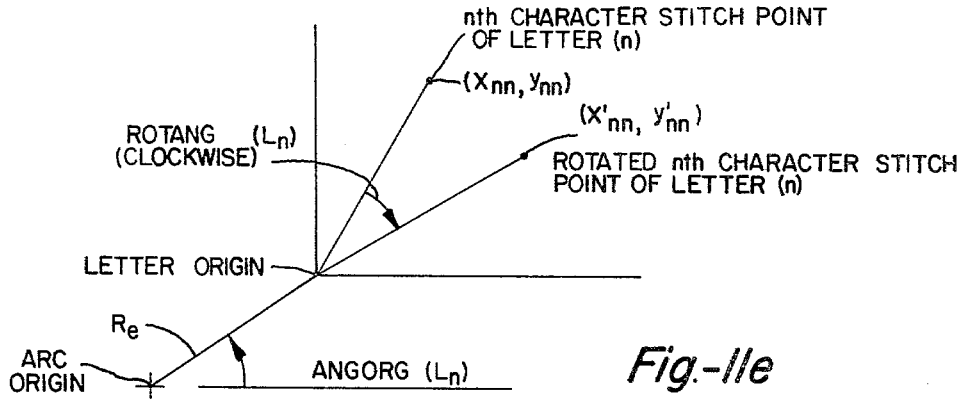
Fig.-11e

METHOD AND APPARATUS FOR STITCHING MATERIAL ALONG A CURVE

FIELD OF THE INVENTION

The present invention relates to computer controlled sewing and embroidery machines, and, in particular, to a method and an apparatus for stitching characters along a desired curve.

BACKGROUND ART

The generation of patterns and the stitching of the generated patterns on fabric or other materials utilizing computer control has been developed. The generated patterns are stored, for example, on appropriate tape for inputting to a computerized controller. Alternatively, one or more predetermined patterns are stored in computer memory using printed circuit boards or other memory storage devices. In another known method of stitching patterns, a predetermined pattern is stored in computer memory and a computer controller includes the capability of providing axis translation of the predetermined pattern so that more than one stitch pattern is available. For example, mirror image stitch patterns can be provided from one predetermined stitch pattern.

Prior to the present invention, in the case of stitching characters along a curve including an arc, the desired pattern of characters positioned along an arc was initially formulated and then this pattern was stored in computer memory. Upon activation, the sewing machine was able to stitch the fabric with the desired pattern using the character pattern stored in the computer memory. The same stitching of characters along an arc could be repeated as many times as desired. However, if different character patterns along a different arc were desired, for example, a new and different stitch pattern was required to be formulated and then stored in the computer memory. The forming of different stitch patterns by an operator for memory storage is a long and tedious procedure. A considerable number of different stitch points must be defined in order to instruct the computer system regarding the location of the new stitch pattern.

The present invention obviates this cumbersome process and eliminates the requirement for storing different stitch points in memory each time a different stitch pattern along an arc is desired. The present invention provides a method and an apparatus for stitching characters, including letters, along a curve, including an arc. The method disclosed herein does not require a memory-stored predetermined stitch pattern in order to stitch characters on fabric along a curve. Rather, the method requires that a user or operator provide necessary inputs to the apparatus. Among the required inputs, the operator selects the characters to be stitched, the magnitude of curvature or radius of the arc along which the selected characters are to be stitched, the direction of the stitching, namely, clockwise or counterclockwise, and the magnitude of a center angle which is used to determine the angular stitch position of the selected characters with reference to 360°.

PRIOR ART STATEMENT

U.S. Pat. No. 4,258,636 to Rolauffs et al. discloses a frame control device used with an embroidery machine. The device provides movement of the frame in x and y directions in order to properly position material, placed on the frame, below a threaded needle. The device includes a processor and computer memories for use in determining the desired position of the frame. The position of the frame, together with material connected thereto, depends upon the pattern to be stitched on the material. The pattern to be stitched is stored on tape and is inputted to computer memory. Using this stored information, the frame is enabled using servomotors driven by amplifiers controlled by the outputs of a d/a converter so that the material is stitched according to the predetermined pattern.

U.S. Pat. No. 4,050,393 to Welcher et al. discloses a bar tacking machine which utilizes stepping motors for moving a work piece. The stepping motors respond to digitized coordinates which represent predetermined positions.

U.S. Pat. No. 4,135,459 to Manabe et al. discloses an automatic sewing machine which includes a fabric clamping member which is moved in x and y directions in response to the activation of stepping motors. The machine includes PROMS which store predetermined line stitch patterns which are to be stitched on the fabric.

U.S. Pat. No. 4,073,247 to Cunningham et al. describes a sewing machine for applying stitching to shirt collars. The machine includes transducer scanning heads for use in providing a computer with a position of a physical feature of the shirt collar. A work holder is driven in x and y directions using d/a converters and servo amplifiers.

U.S. Pat. No. 3,982,491 to Herzer et al. describes a program controlled sewing machine which includes a programmable read only memory which is accessed by electrical control circuitry for initiating a sequence of pulses for application to stepping motors. The programmable read only memory stores a predetermined pattern of movement of a work holder.

U.S. Pat. No. 3,208,414 to Reeber et al. illustrates an automatic sewing apparatus which is capable of varying the size of a predetermined pattern using coupling gears.

U.S. Pat. No. 3,872,808 to Wurst discloses a sewing machine apparatus characterized by a plurality of predetermined stitch patterns stored in memory.

U.S. Pat. No. 3,830,175 to Levor describes a sewing machine which includes changeable gears for varying the length of stitches.

U.S. Pat. No. 3,752,098 to Logan et al. illustrates a programmed memory tape for controlling movement of a carriage with respect to a threaded needle.

U.S. Pat. No. 3,573,581 to Dutko et al. provides a system utilizing logic circuitry for controlling sewing machine needle up and down positions.

DISCLOSURE OF THE INVENTION

In accordance with the present invention, a method and an apparatus are provided for stitching characters along an arc which is defined by a radius inputted to the apparatus by the user thereof. The characters to be stitched are selected by the user from a plurality of characters stored in a character memory. The character memory communicates with a microprocessor which controls the operation of the apparatus using program instructions stored in an erasible programable read only memory (EPROM). Using the radius, character stitch points of the selected characters, an inputted center angle, an inputted direction of stitching and dimensions of character envelopes of the selected characters, the microprocessor rotates or changes the orientation of the selected characters and generates step signals for controlling activation of an x-stepping motor and a y-stepping motor. The energization of the two stepping motors results in a movement of a carriage assembly, together with material to be stitched connected thereto, in horizontal and vertical directions. The step signals continue until the material is positioned at a location for providing a stitch along the desired arc.

More particularly, the apparatus of the present invention includes a keyboard for inputting information to the microprocessor by the user of the apparatus. The information includes the magnitude of the radius of the arc along which characters are to be stitched on the material using a threaded needle. The characters to be stitched are selected from a plurality of characters using keyboard inputs to the microprocessor. The plurality of characters are stored in the character memory at predetermined locations to permit microprocessor accessing of the selected characters. Each of the stored characters is defined by a number of character stitch points. Each character stitch point is defined with x and y coordinates and a function code. The function code is used in indicating a predetermined pattern which accompanies the character stitch points. For example, the pattern to be stitched may be a straight line of stitches, an arc of stitches, or a straight or curved column of stitches. One or more of these patterns are combined together to form each character stored in the character memory.

The apparatus further includes a RAM (random access memory) for storing data and other necessary system parameters. The microprocessor also controls the energization of the x and y stepping motors. When power is applied to the x-stepping motor, a carriage assembly is moved in a horizontal or x direction. When power is applied to the y-stepping motor the carriage assembly is moved in a vertical or y direction. The microprocessor controls the application of power to the x and y stepping motors through the sending of step signals to each of the power supplies connected to the x and y stepping motors. The number of the x and y step signals depends upon the location of the next stitch point to be stitched in the material. The microprocessor also monitors the vertical movement of the threaded needle by means of a sensing circuit. The output of the sensing circuit indicates to the microprocessor the status of the threaded needle position, namely, when the needle is out of the material. When the needle is out of the material, the carriage assembly is moved to the next stitch location using the approprate step signals.

In operation, the user inputs the required information including the characters to be stitched, the radius of the arc along which the selected characters are to be stitched, and the center angle of the selected arc. Based on this user supplied information, the apparatus determines the amount of rotation or change in orientation of each of the selected characters. Specifically, in order to stitch characters along the arc having the given radius, each of the x, y coordinates of the character stitch points, which define the selected characters, must be changed to rotated stitch points, i.e., the x, y coordinates defining the selected characters stored in the character memory are modified using the microprocessor so that the carriage assembly can be moved to locations wherein the selected characters are stitched along the desired arc. Using function codes accompanying a number of character stitch points, and together with the rotated character points themselves, the microprocessor is able to generate step signals for controlling the stepping motors and the movement of the carriage assembly. Between stitches, the carriage assembly is moved to a position corresponding to the rotated or changed in orientation x, y coordinates. The apparatus continues the foregoing process until all of the selected characters have been stitched along the desired arc on the fabric or material.

In view of the above description, it is readily seen that the present invention provides a number of worthwhile advantages. Most important, the method and apparatus herein described enables the user thereof to select and have stitched a curved stitch pattern without the necessity of formulating and storing a new stitch pattern whenever any change in the pattern is desired. The present invention offers significant flexibility and ease of operation in the sewing and embroidery art since it provides the user with varied and considerable options directed to stitching characters along a curve including an arc. No longer is the user confined to predetermined curved stitch patterns stored in the memory of a computer controlled sewing machine. The apparatus changes the orientation of selected stored characters utilizing information easily inputted by the operator thereof and then uses rotated stitch points to drive a carriage assembly so that the material to be stitched is properly positioned beneath a threaded needle.

Additional advantages of the present invention will become readily apparent from the following discussion when taken in conjunction with the accompanying drawings.

BRIEF DESCRIPTION OF THE DRAWINGS

FIGS. 10*a*–10*f* illustrate column, arc, and curved column stitch patterns for forming characters and flow charts for generating delta stitch points; and FIGS. 11*a*–11*f* illustrate details of the method of rotating character stitch points for stitching along an arc.

DESCRIPTION OF THE PREFERRED EMBODIMENT

Figure 1:
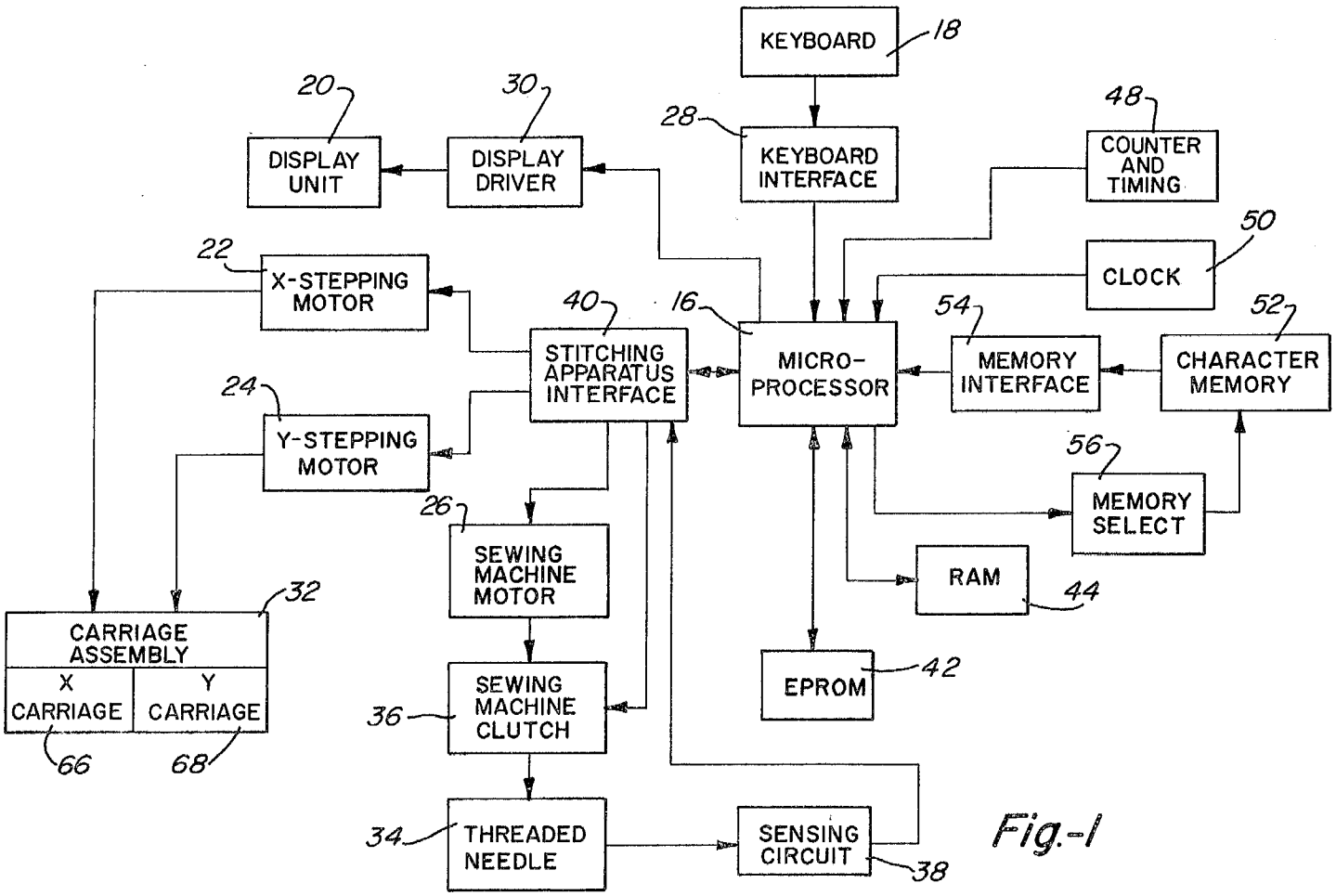
FIG. 1 is a block diagram of the present invention.

In accordance with the present invention, an apparatus for use in stitching characters along a curve and, in particular, along a determined arc is provided in block diagram form in FIG. 1. The apparatus is particularly useful in the embroidery art for stitching various curved character patterns on fabric or other materials.

The apparatus includes a microprocessor 16 for controlling the operation of the apparatus. The microprocessor 16 communicates with a number of peripheral devices including a keyboard 18, a display unit 20, an x-stepping motor 22, a y-stepping motor 24, and a sewing machine motor 26.

The keyboard 18 is linked to the microprocessor 16 through a conventional keyboard interface 28. The keyboard 18 enables the operator or user to input information to the microprocessor 16 which is necessary for stitching characters along an arc. The keyboard 18 includes a number of input keys similar in notation to a standard typewriter keyboard. The display unit 20 is a fluorescent dot matrix unit for displaying information to the user, and in particular, is used to assist the user in inputting the necessary information for stitching characters along an arc to the microprocessor 16. The display unit 20 is driven by a display driver 30, which is coupled to the microprocessor 16. The power supply of the x-stepping motor 22 is energized by step pulses serially applied thereto from the microprocessor 16. The power supply of the y-stepping motor 24 is also energized by step pulses serially applied thereto by the microprocessor 16. Both stepping motors 22, 24 are connected to a carriage assembly 32. When the x-stepping motor 22 is energized or activated by one or more step pulses, the carriage assembly 32 moves in a horizontal or x direction. When the y-stepping motor 24 is energized by one or more step pulses, the carriage assembly 32 moves in a vertical or y direction.

The sewing machine motor 26 is used to provide the vertical or up-down movement of a threaded needle 34. A sewing machine clutch 36 interconnects the sewing machine motor 26 and the threaded needle 34 and is provided primarily to assure that the threaded needle is out of the fabric when the sewing machine motor 26 is deactivated. A sensing circuit 38 is provided to monitor the position of the threaded needle 34 and outputs a signal to the microprocessor 16 when the threaded needle 34 is out of the material or fabric being stitched so that the microprocessor 16 can initiate energization of the x-stepping motor 22 and y-stepping motor 24 when required. A stitching apparatus interface 40 couples the stepping motors 22, 24, the sewing machine motor 26 and sensing circuit 38 to the microprocessor 16.

The stitching apparatus interface 40 is a conventional I/O interface for receiving and transferring control signals, including step signals, from the microprocessor 16. The step signals are used to properly drive the stepping motors, 22, 24 while a control signal is provided to power the sewing machine motor 26.

The microcomputer system includes, in addition to the microprocessor 16 itself, an erasible programmable read only memory (EPROM) 42, a random access memory (RAM) 44, a counter and timing network 48, and a clock or oscillator 50. The EPROM 42 stores program instructions or the software required for execution by the microprocessor 16, including the instructions necessary for the implementation of the steps of FIGS. 10B, 10D, 10F, and 11F. The RAM 44 stores necessary and determined data which is used by the microprocessor 16, including character information inputted by the user. The RAM 44 stores the rotated absolute x,y coordinates corresponding to the stitch points for accessing by the microprocessor 16 in moving the carriage assembly 32. The counter and timing network 48 and clock 50 are standard timing circuits which communicate with the microprocessor 16 and provide the timing signals necessary for proper operation of the microprocessor 16. The clock 50 outputs a 2.5 MHZ signal for use by the microcomputer system.

The apparatus also includes a character memory 52. The character memory 52 is coupled to the microprocessor 16 through a memory interface 54. The character memory 52 stores a plurality of characters from which one or more characters are selected by the microprocessor 16, through one or more inputs by the user of the apparatus, for stitching the selected characters along the arc desired by the user. The characters stored in the character memory 52 are also grouped according to style or type of character. By way of example, letters of the alphabet are grouped according to block style lettering, script style, and old English style lettering. The operator of the apparatus, through the keyboard 18, selects the type of lettering to be stitched using a memory select 56 which communicates with the character memory 52 and the microprocessor 16.

Each of the characters stored in the character memory 52 is defined according to a reference or first orientation using one or more character stitch points and at least one function or separation (OP) code. The character stitch points of each character are defined using x, y coordinates. In the preferred embodiment, each character stitch point is defined with reference to an adjacent character stitch point. A first character stitch point is defined with reference to a character origin point. Each character stitch point of a character is redefined with reference to the character origin point by means of a program routine stored in the EPROM 42 when a character is selected from the character memory 52. The given character stitch points of each character are located at predetermined points along the boundaries of the characters and within the characters themselves. A character can be comprised of one or more straight lines, curved lines, columns or curved columns joined together. For example, in stitching the upper case letter J, a horizontal column of stitches, a vertical column of stitches joined to the center of the horizontal column, and a curved column of stitches joined to the end of the vertical column are combined to produce the letter J in block style. This will be described in great detail during the discussion of the apparatus operation.

Figure 3:
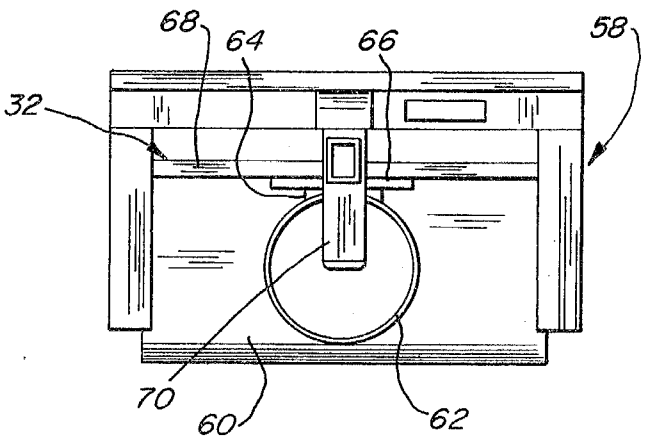
FIG. 3 is a top plan view of FIG. 2.
Figure 2:
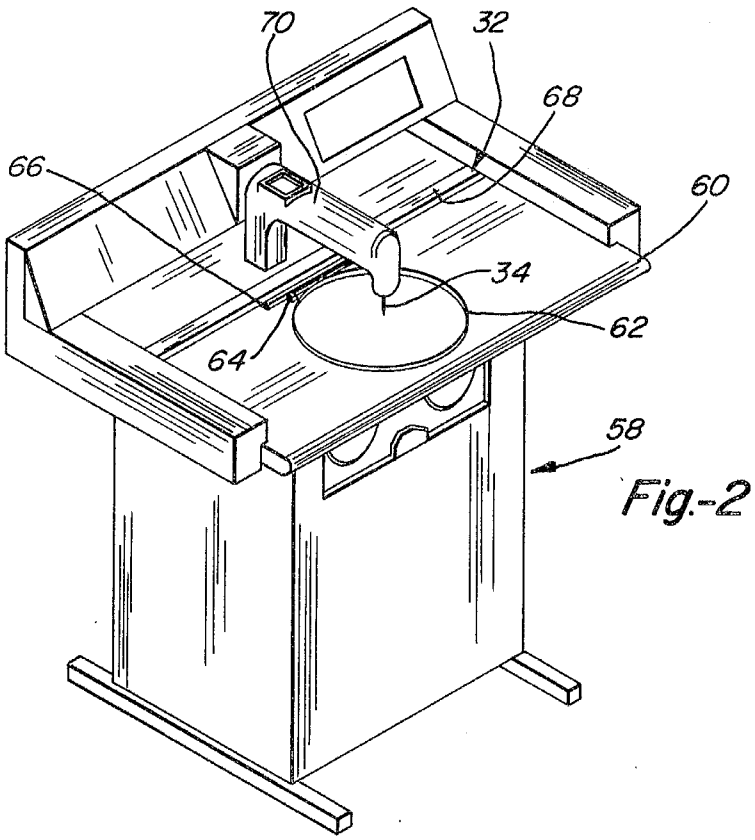
FIG. 2 is a perspective view showing the housing and sewing machine of the present invention.

A more detailed discussion of the mechanical operation and mechanical portions of the apparatus are provided with reference to FIGS. 2–8. As seen in FIGS. 2 and 3, the apparatus includes a housing 58 for supporting the hardware required for proper operation of the present invention. A rectangular table 60 is mounted on the housing 58. The table 60 is provided to underlie and support fabric or other materials to be stitched. The fabric to be stitched is fastened to a hoop 62 which has an insert connector 64 attached to a portion of its periphery. The insert connector 64 is essentially a rod which has its ends inserted into openings formed in an x-carriage 66 of the carriage assembly 32 so that the hoop 62 and fabric is attached thereto. A y-carriage 68 is also part of the carriage assembly 32. The y-carriage 68 overlies much of the x-carriage 66 and extends laterally across the width of the table 60. A sewing machine 70 is supported in a stationary manner above the fabric and the threaded needle 34 extends vertically from the sewing machine 70.

Figure 4:
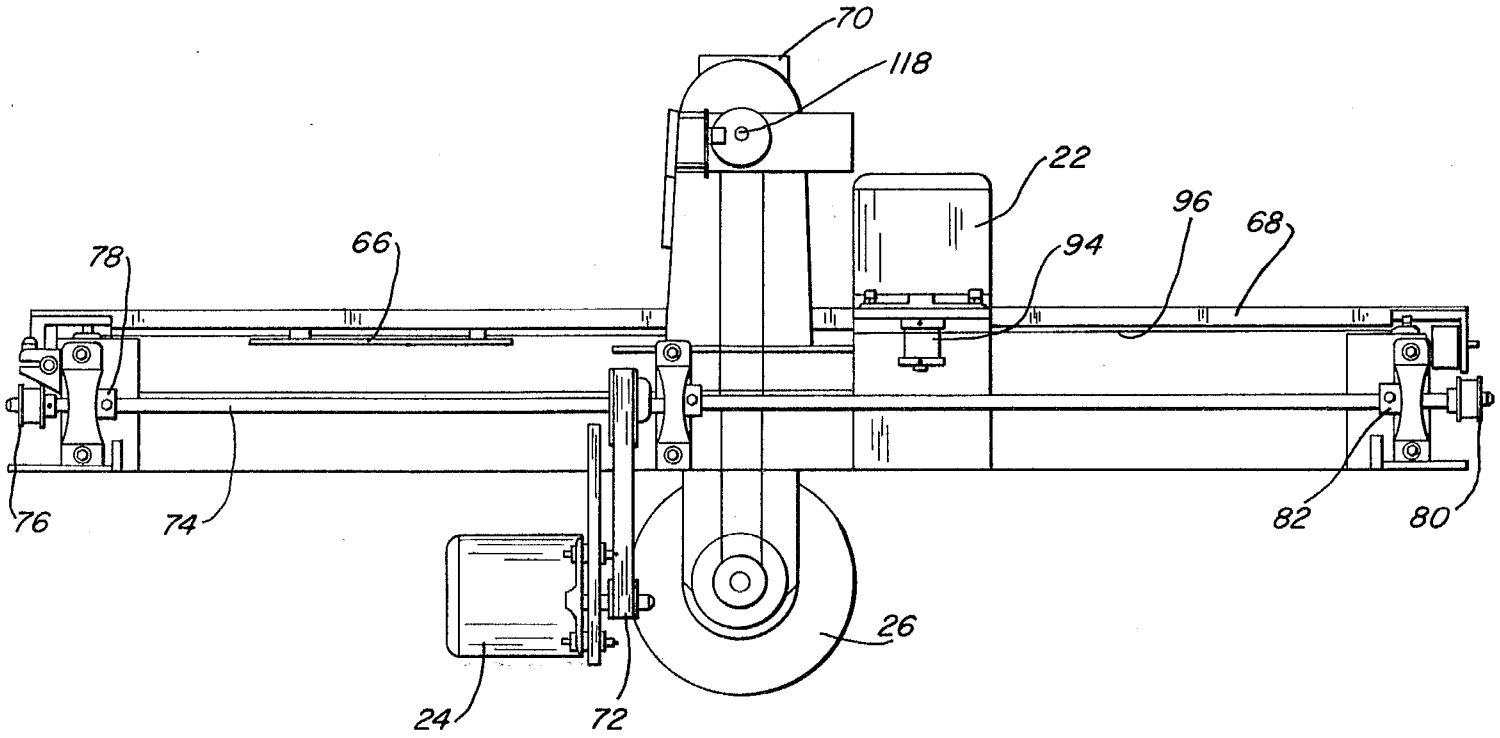
FIG. 4 is a rear elevational view showing a portion of the carriage assembly of the present invention.
Figure 5:
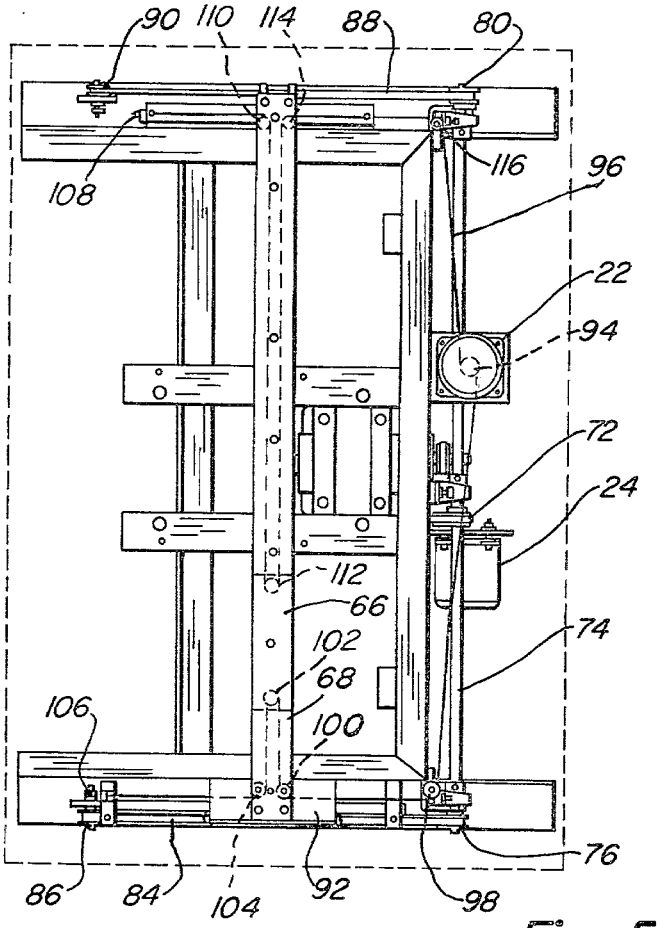
FIG. 5 is a top plan view showing further details of the carriage assembly with the sewing machine removed.
Figure 6:
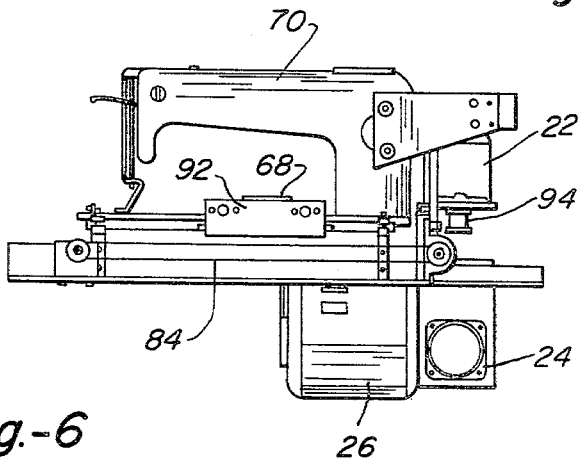
FIG. 6 is a side elevational view of the sewing machine and carriage assembly.

Additional features of the carriage assembly 32, together with the stepping motors 22, 24 are shown in FIGS. 4, 5 and 6. The output shaft of y-stepping motor 24 is coupled by means of a y-belt 72 of a y-rod 74 which is located and extends across the back or rear portion of the apparatus. A first end of the y-rod 74 is received by a first rearward roller 76 after passing through a bearing member 78. The second and opposite end of the y-rod 74 is received by a second rearward roller 80 after passing through a bearing member 82. As illustrated in FIG. 5, a y-drive belt 84 is positioned for rotation about the first rearward roller 76 and a first forward roller 86 while a y-drive belt 88 is positioned for rotation about the second rearward roller 80 and a second forward roller 90.

The y-drive belt 84 is connected to the bottom side of a y-plate 92. Y-plate 92 is also connected to y-carriage 68 and is perpendicular thereto. When the power supply of y-stepping motor 24 is energized or enabled by step signals from the stitching apparatus interface 40, y-belt 72 couples the rotation of the y-stepping motor 24 output shaft to the y-rod 74. The rotary movement of y-rod 74 results in the movement of y-drive belts 84, 88 about first and second rearward rollers 76, 80 and about first and second forward rollers 86, 90. Since the y-drive belt 84 is fastened to the y-carriage 68 through y-plate 92, y-carriage 68 moves in a vertical direction or along a y axis. The direction of vertical movement of y-carriage 68 depends upon the direction of rotation of the output shaft of the y-stepping motor 24.

The x-stepping motor 22 has a spindle 94 connected to the bottom end thereof, as seen in FIG. 4. The spindle 94 rotates whenever the power supply of x-stepping motor 22 is activated. A cable 96 has portions thereof wrapped around the spindle 94. In the direction towards the first rearward roller 76 from the x-stepping motor 22, the cable 96 is positioned about a first sheave 98. The cable 96 is then directed to a first rearward pulley 100. From the first rearward pulley 100, the cable 96 extends about a first return pulley 102 such that the cable 96 is directed back to a first forward pulley 104. A first end of the cable 96 is then attached at connection point 106, which is located adjacent the first forward roller 86. In a similar manner, a second end of the cable 96 is attached to a second connection point 108, which is located adjacent the second forward roller 90. The cable 96 extends to the second connection point 108 from a second forward pulley 110 which receives the cable from a second return pulley 112. The cable 96 is directed to the second return pulley 112 by a second rearward pulley 114 and a second sheave 116. The second sheave 116 also receives the cable 96 from the spindle 94. The first rearward and forward pulleys 100, 104 and the second forward and rearward pulleys 110, 114 are mounted at opposite ends of y-carriage 68 to enable movement of the x-carriage 66 in the vertical or y direction whenever the y-stepping motor is energized.

Both the first and second return pulleys 102, 112 are fastened to the x-carriage 66. The cable 96 is wrapped about the spindle 94 so that rotation of the spindle 94 in one direction results in a movement of the x-carriage 66 in a first direction through the decreasing of the length of cable 96 between one of the return pulleys 102 or 112 and the spindle 94. As cable portions 96 are wrapped about a portion of the spindle 94 in moving the x-carriage 66 in a first direction, other cable portions of cable 96 are unwrapped from spindle 94 so that the length of cable 96 is increased between the other one of the return pulleys 102 or 112 and the spindle 94. In such a manner, the x-carriage 66 and the fabric-carrying hoop 62 are moved in a lateral direction along a horizontal or x axis.

Figure 7:
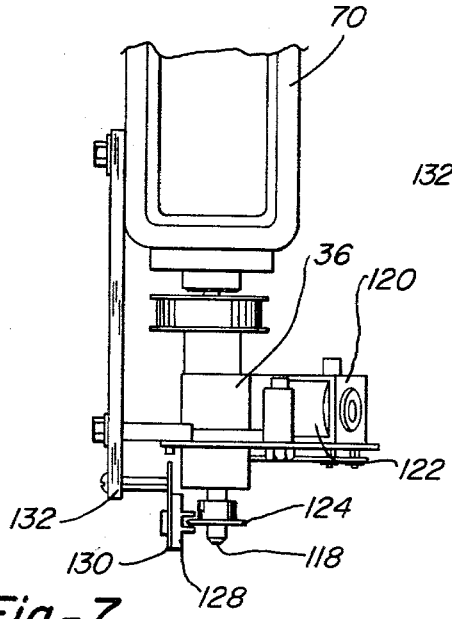
FIG. 7 is an enlarged, fragmentary, top plan section showing the sewing machine clutch.

Also depicted in FIGS. 4 and 6 is the sewing machine motor 26 for driving a sewing shaft 118. The sewing shaft 118 is joined to the threaded needle 34 for providing vertical or up/down movement of the threaded needle 34 for stitching and carriage moving purposes. The sewing shaft 118 is coupled to the threaded needle 34 by the sewing machine clutch 36, as illustrated in FIG. 7. The sewing machine clutch 36 is enabled by means of the energization of a solenoid 120 which retracts a plunger 122 to permit rotation of the sewing machine clutch 36 and, consequently, enable the rotation of the sewing shaft 118 so that the threaded needle 34 moves up and down.

Figure 8:
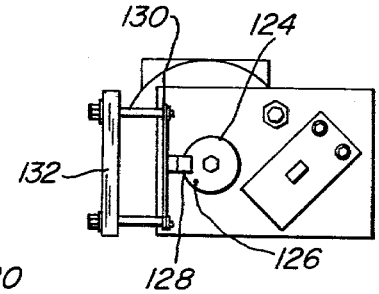
FIG. 8 is an enlarged, fragmentary side elevational section showing the timing wheel of the present invention.
Figure 9:
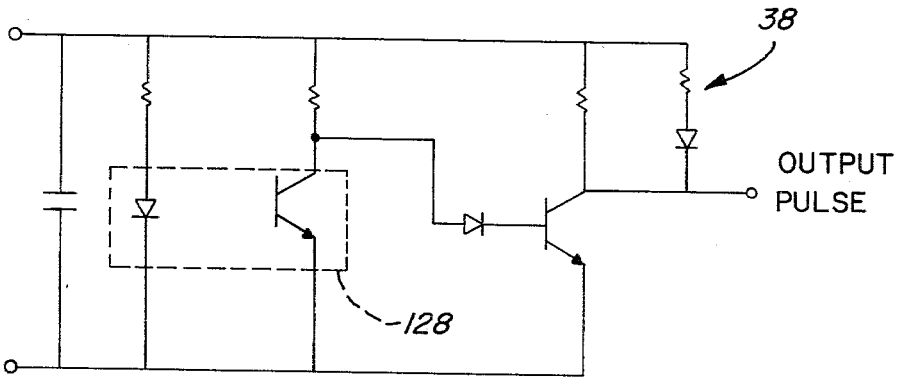
FIG. 9 is a circuit schematic of the sensing circuit.

Elements of the sensing circuit 38 are illustrated in FIGS. 7, 8 and 9. A timing wheel 124 surrounds the circumferential periphery of the sewing shaft 118 at the back of the sewing machine 70. The timing wheel 124 includes a wheel aperture 126 adjacent the periphery thereof. A photosensor 128 is mounted on a board 130 adjacent the periphery of the timing wheel 124. The board 130 is attached to a bracket 132 which is connected to the sewing machine 70.

During approximately one-half rotation of the sewing shaft 118 and timing wheel 124, the threaded needle 34 is in the fabric in order to stitch the fabric. During the remaining portion of the rotation of the sewing shaft 118 and timing wheel 124, the threaded needle 34 is out of the fabric so that the x-carriage 66 and/or y-carriage 68, as well as the fabric connected thereto, can be moved to the next desired stitch position. The wheel aperture 126 is used to provide an indication to the microprocessor 16 of the position of the threaded needle 34. In this regard, the sensing circuit 38 of FIG. 9 produces an output pulse indicating that the threaded needle 34 is moving upwardly and out of the fabric. The state of the photosensor 128 controls the output signal such that a negative-going output pulse signal indicates to the microprocessor 16 that the wheel aperture 126 of the timing wheel 124 has just been sensed by the sensing circuit 38. The wheel aperture 126 is positioned on the timing wheel 124 such that, when the photosensor 128 is in alignment with the wheel aperture 126, the threaded needle 34 is just moving vertically out of the fabric. Upon receiving this status condition, the microprocessor 16 is able to initiate proper movement of the x-carriage 66 and/or y-carriage 68 while the threaded needle 34 is out of the fabric.

In carrying out the present invention, particular hardware can be utilized. The microprocessor 16 is a model number Z-80CPU of Zilog, Incorporated of Cupertino, Calif. The counter and timing network 48 and keyboard interface 28 can also be obtained from Zilog, Inc. The keyboard 18 is a Model Number 756 of George Risk Industries, Inc. of Kimball, Neb. The display unit 20 is made by Burroughs Corporation of Pasadena, California. The memory select 56 can be obtained from Texas Instruments under model number 74-LS138. The x-stepping motor 22 and y-stepping motor 24 are each a Model Number M093-FD301 of Superior Electric Company of Bristol, Conn. The sewing machine motor 26 is a model number 6K439 of Dayton Electric Manufacturing of Chicago, Ill. The sewing machine clutch 36 is a Model Number 3B4 of Warner Electric Brake and Clutch Company of Beloit, Wis.

In discussing the operation of the apparatus and the necessary program instructions for carrying out the invention, reference is first made to FIG. **11*f* which illustrates necessary inputs to be provided by the user or operator to the microprocessor 16 through the keyboard 18** for stitching selected characters along an arc.

Although the following discussion is directed to the stitching of letters of the English alphabet, it is readily understood that other characters, including symbols, can be stitched along a curve, including an arc, using the method and apparatus of the present invention.

The following sets forth definitions of input parameters important to the following description:

Radius provides the magnitude of the radius R of the arc (as noted in FIG. 11*b*) along which selected characters are to be stitched.

Letters represents the inputting of characters or letters by the user which are to be selected from the character memory 52 for stitching along the desired arc.

Center Angle provides the angle defined by a radial line from an Arc Origin point of the desired arc to the mid point or center of the letters to be stitched and a horizontal axis through the Arc Origin. The Arc Origin is determined by the user in moving the carriage assembly 32 and material to be stitched to a desired location relative to the threaded needle 34 prior to stitching. The center angle has a range of 0°–360°, in one degree increments.

Stitch Direction provides to the microprocessor 16 a clockwise or counterclockwise direction for stitching the selected letters along the arc having the radius R selected by the user.

Stitch Density provides the number of stitches/inch for the letters to be stitched. The stitch density has a range of 10–99 stitches/inch. It is understood that stitch density can be defined using a distance dimension other than inches.

Letter Style provides the type or style of letters to be stitched including, for example, block style lettering.

Letter Height provides the desired height of the letters to be stitched. The plurality of letters are stored in the character memory 52 having a reference height of two inches. The letter height inputted by the user is made proportional to this two inch height by the microprocessor. The letter height has a preferred range of ¼–3 inches.

Arc Mode provides the user with two choices with respect to the starting and finishing stitch points of the letters to be stitched. A Normal Arc Mode results in a movement of the carriage assembly 32 so that the threaded needle 34 is located at the mid point of the letters to be stitched. From this starting point, the carriage assembly 32 then moves to the starting point of the first letter to be stitched. In an Arc From Center Mode, the starting and finishing point of the carriage assembly 32 is such that the threaded needle is positioned at the Arc Origin. The carriage assembly 32 moves from the Arc Origin to the starting point of the first letter to be stitched. After sewing the selected letters along the desired arc, the carriage assembly returns so that the threaded needle 34 is positioned above the Arc Origin.

In order to understand the apparatus capability of providing various stitch densities in stitching characters, including letters and symbols, along an arc, reference is made to FIGS. 10*a*–10*f*. These figures illustrate straight column, arc and curved column stitch patterns and the step necessary for stitching such patterns using the given character stitch points. As previously noted, each character stored in the character memory 52 is defined using character stitch points. Using these predetermined character stitch points, delta stitch points can be determined by the microprocessor using the program instructions stored in the EPROM 42. The delta stitch points are located between the characters stitch points and the determination of their location depends upon the stitch density.

Figure 10E:
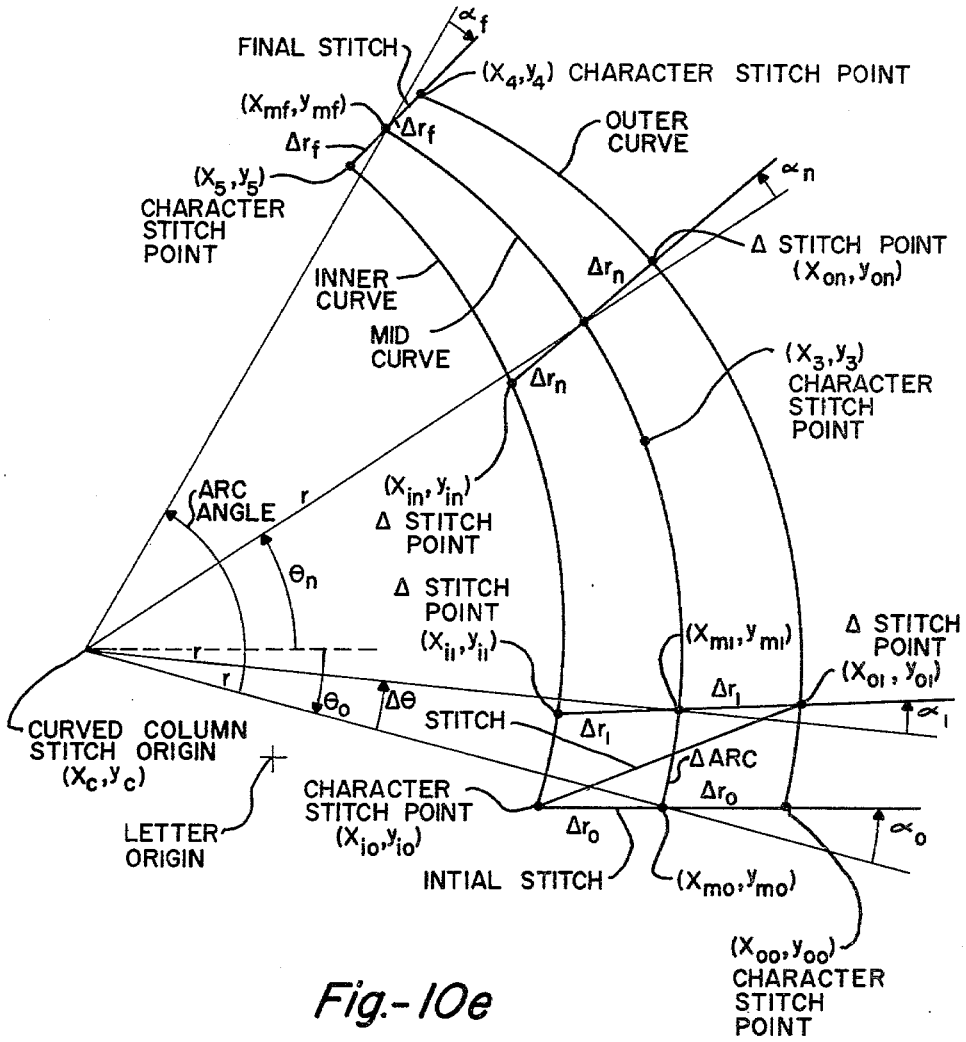

Referring to FIG. 10*a*, it is seen that a straight column of stiches can be defined in character memory 52 using four x, y character stitch point, i.e., $(x_1, y_1)$, $(x_2, y_2)$, $(x_3, y_3)$ and $(x_4, y_4)$. These four characters stitch points are located at the ends and outer boundaries of the stitch column. The magnitudes of the x,y coordinates can be defined with respect to a Letter Origin having x,y coordinates of (0,0). As shown in FIG. 10*c*, a circular arc having stitches of equal length can be defined using three x,y character stitch points. Points $(x_0, y_0)$ and $(x_3, y_3)$ are located at the ends of the arc while $(x_2, y_2)$ is located at the mid point of the arc. Like the straight column of stitches, the magnitudes of $(x_0, y_0)$, $(x_2, y_2)$ and $(x_3, y_3)$ can be defined with respect to a Letter Origin of (0,0). As shown in FIG. 10*e*, a curved column of varying width (length of line between the outer curve and the inner curve varies) can be defined using five character stitch points. Points $(x_{i0}, y_{i0})$ and $(x_5, y_5)$ define the ends of an inner curve while $(x_{o0}, y_{o0})$ and $(x_4, y_4)$ define the ends of an outer curve. The subscript "o" indicates an outer curve point. The subscript "i" indicates an inner curve point. The point $(x_3, y_3)$ provides the mid point of a mid curve positioned at one-half of the stitch distance between the outer and inner curves. Again, each of the x,y coordinates of the character stitch points can be defined with respect to a Letter Origin having (x,y) coordinates of (0,0).

As previously discussed, a function code accompanies each character stitch point in the character memory 52. The function code indicates to the microprocessor 16 which of the stitch patterns, straight line, arc, column of stitches, or curved column is to be stitched. By way of example, to stitch a column of stitches as illustrated in FIG. 10*a*, a function code of one accompanies the character stitch point $(x_1, y_1)$, a function code of two accompanies the character stitch point $(x_2, y_2)$, a function code of two accompanies the character stitch point $(x_3, y_3)$, and a function code of two accompanies the character stitch point $(x_4, y_4)$. When the microprocessor 16 accesses the character memory 52 and finds this combination of function codes, namely, 1, 2, 2, 2 accompanying four successive character stitch points, the microprocessor 16 determines that a column of stitches is to be stitches. Similarly, a combination of function codes 2, 3, 3 indicates an arc is to be stitched using the character stitch points accompanying these function codes. A combination of function codes, 1, 2, 3, 2, 2 accompanying five character stitch points indicates that a curve column is to be stitched.

Because of the use of the character stitch points and the function codes, various stitch densities can be selected by the user. Based on the stitch density selected, delta stitch points can be determined. With respect to FIG. 10*a*, the number of stitches between the stitch defined by the distance between the coordinates $(x_1, y_1)$ to $(x_2, y_2)$ and the stitch defined by the distance between the coordinates $(x_3, y_3)$ to $(x_4, y_4)$ can be varied. As illustrated by way of example in FIG. 10*a*, nine stitches are provided (excluding the first and last stitch) but it is understood that the number of such stitches can be changed by the user through the selection of different stitch densities.

To determine the x, y coordinates of the delta stitch points of FIG. 10*a*, the microprocessor 16 executes a routine stored in the EPROM 42 implementing the steps of FIG. 10*b*. Basically, the character stitch points are first redefined with reference to the Arc Origin of the desired arc along which characters are to be stitched using the inputted radius R and center angle CA. The mid points ($x_{m1}$, $y_{m1}$) and ($x_{m2}$, $y_{m2}$) of the stitches ($x_1$, $y_1$) to ($x_2$, $y_2$) and ($x_3$, $y_3$) to ($x_4$, $y_4$) are then determined. From these mid points, the length of bisector B of these two stitches is found. Using the stitch density and the bisector length B, the magnitudes of delta $x_1$, delta $x_2$, delta $y_1$, and delta $y_2$ can be found. Based on these values, the x, y coordinates of the delta stitch points can be determined with reference to the center point of the desired arc (Arc Origin) having x, y coordinates of (0,0). From these absolute character stitch points and absolute delta stitch points, the amount of change in the x and y directions from the previous stitch points to the succeeding stitch points can be determined. From these magnitudes of change, the x-stepping motor 22 and y-stepping motor 24 can be properly activated through microprocessor 16 control the move the carriage assembly 32 to each succeeding stitch point in order to form the stitched column.

It is also readily appreciated that an additional column of stitches can be joined to a previous column of stitches in forming letters or other characters. Character stitch points ($x_5$, $y_5$) and ($x_6$, $y_6$), together with character stitch points ($x_3$, $y_3$) and ($x_4$, $y_4$) define another column of stitches. The microprocessor 16 recognizes the function codes of 2, 2 accompanying the character stitch points ($x_5$, $y_5$), ($x_6$, $y_6$) and the function codes of 2, 2 accompanying the character stitch points ($x_3$, $y_3$) and ($x_4$, $y_4$) to determine that column of stitches adjacent the just stitched column of stitches is to be provided so that the delta stitch points of the adjacent column can be found in absolute x,y coordinate values.

The number of delta stitches between character stitch points of the arc stitch pattern illustrated in FIG. 10*c* is also controlled by the user. To determine the x, y coordinates of the delta stitch points for the arc pattern of FIG. 10*c*, the microprocessor 16 executes a routine implementing the steps of FIG. 10*d*. As indicated before, an arc of a circle is defined using three character stitch points stored in the character memory 52. It is a well-known geometric theorem that a circle can be defined using three points. Based on the three character stitch points ($x_0$, $y_0$), ($x_2$, $y_2$), and ($x_3$, $y_3$) stored in the character memory 52, the arc stitch origin ($x_c$, $y_c$) and the radius r of the arc can be found. In a preferred method of determining ($x_c$, $y_c$) and r, the point ($x_0$, $y_0$) is initially normalized. That is, $x_0$ and $y_0$ are each set to zero to define an origin point of a new coordinate system. The points ($x_2$, $y_2$) and ($x_3$, $y_3$) are redefined in magnitude with reference to the normalized ($x_0$, $y_0$) by subtracting the unnormalized $x_0$ value from $x_2$ and $x_3$ and subtracting the unnormalized $y_0$ value from $y_2$ and $y_3$. From these normalized points, ($x_c$, $y_c$) and r can be found with reference to the point ($x_0$, $y_0$) using the aforementioned geometric thereom. Using ($x_c$, $y_c$), the angles $alpha_1$ and $alpha_2$ can be determined. $Alpha_1$ is defined by a horizontal line through the arc stitch origin ($x_c$, $y_c$) and a radial line to the character stitch point ($x_0$, $y_0$). $Alpha_2$ is defined by a horizontal line through the arc stitch origin ($x_c$, $y_c$) and a radial line to the character stitch point ($x_3$, $y_3$). After determining the angles $alpha_1$ and $alpha_2$, the arc angle is found. The arc angle is the angle defined between radial lines from the arc stitch origin ($x_c$, $y_c$) to the end points of the arc stitch of the selected letter to be stitched as represented in FIG. 10*c*. Based on the arc angle and arc length, as well as the stitch density, delta theta can be found. Delta theta defines the angle between successive stitch points along the arc length of the letter. The distance between successive stitch points is the same for a given stitch density. Using the determined radius r, delta theta, and $alpha_1$, each of the delta stitch points having x and y coordinate values with reference to the arc stitch origin ($x_c$, $y_c$) can be found by means of rotation formulas. Specifically, $x_n = r \cos(theta_n)$ and $y_n = r \sin(theta_n)$, where n represents the nth delta stitch point between character stitch points. After determining ($x_n$, $y_n$) with respect to a coordinate system having an origin at ($x_c$, $y_c$), each delta stitch point, including ($x_n$, $y_n$), is redefined with reference to the Arc Origin using the unnormalized character stitch point ($x_0$, $y_0$), which is defined with reference to the Arc Origin and the coordinate values of ($x_c$, $y_c$) defined with reference to the point ($x_0$, $y_0$). From these absolute character stitch points and absolute delta stitch points, the previous stitch points can be substracted from the succeeding stitch points to determine the amount of change between stitch points. Using these determined magnitudes of change, the x-stepping motor 22 and y-stepping motor 24 can be properly activated through microprocessor 16 control to move the carriage assembly to the next stitch point along the arc stitch pattern.

FIGS. 10*e* and 10*f* provide an implementation for stitching a curved column of stitches having a variable width between end stitches ($x_{o0}$, $y_{o0}$) to ($x_{i0}$, $y_{i0}$) and ($x_4$, $y_4$) to ($x_5$, $y_5$) and wherein the angle each stitch forms with respect to a radial line intersecting the mid point of the stitch changes. The radial line originates from a curved column stitch origin ($x_c$, $y_c$). The coordinate values of ($x_c$, $y_c$) and the magnitude of the radius r of the radial line from ($x_c$, $y_c$) to the mid curve are determined as previously discussed with respect to FIGS. 10*c* and 10*d* using the defined mid curve. Specifically, the mid points ($x_{m0}$, $y_{m0}$) and ($x_{mf}$, $y_{mf}$) are obtained using the given character stitch points ($x_{i0}$, $y_{i0}$), ($x_{o0}$, $y_{o0}$), ($x_4$, $y_4$), and ($x_5$, $y_5$). A translation of axis from the Arc Origin to ($x_{m0}$, $y_{m0}$) is made so that ($x_{m0}$, $y_{m0}$) is normalized to (0,0). From the magnitudes of the points ($x_{m0}$, $y_{m0}$), ($x_3$, $y_3$), and ($x_3$, $y_3$), and ($x_{mf}$, $y_{mf}$), the radius r and curved column stitch origin ($x_c$, $y_c$) can be found using the algorithm for determining a circle defined by three points. Like the arc stitch determinations of FIG. 10*d*, the arc angle, arc length, delta arc, and delta theta of the mid curve of FIG. 10*e* can be determined. Delta theta is a constant value and each delta theta is formed by a radial line from the curved column stitch origin to the mid point of a stitch.

Inasmuch as the angle alpha, which each stitch forms with respect to a radial line to the mid point of the stitch, changes from stitch to stitch, angle alpha must be determined for each stitch. Basically, the magnitude of the angle change between $alpha_0$ and $alpha_f$ is determined. Using this difference and the total number of delta arcs between the given initial and final stitches, each angle $alpha_n$ can be found. The angle $alpha_0$ is defined by the initial stitch and radial line through the mid point of the initial stitch. The angle $alpha_f$ is defined by the final stitch and a radial line through the mid point thereof. These two angles can be found based on known geometric and trigonometric functions using the coordinate values of the center of the mid curve ($x_c$, $y_c$) and the mid points and end points of the given initial and final stitches. Basically, arctan ($y_c/x_c$) and the arctan $((y_{o0}-y_{m0})/(x_{o0}-x_{m0}))$ are found in order to determine alpha$_0$ while arctan $((y_{m0}-y_c)/(x_{m0}-x_c))$ and the arctan $((y_4-y_{mf})/(x_4-x_{mf}))$ are found to determine alpha$_f$.

Delta $r_0$ is the distance between the mid curve and the outer curve, as well as the distance between the mid curve and the inner curve, for the initial stitch. Delta $r_f$ is the distance between the mid curve and the outer curve, as well as the distance between the mid curve and the inner curve, for the final stitch.

Since the distance between the outer curve and inner curve varies, e.g., delta $r_o$ does not equal delta $r_f$, delta r must also be determined for each stitch. Basically, in order to determine delta r, the difference in stitch length between the first stitch and the final stitch is initially determined. Using this distance difference, the delta distance stitch can be found as a function of the stitch density and the length of the mid curve as defined in the steps of FIG. 10*f*. From this delta distance/stitch, delta r is found. In addition, the angle theta$_0$ is also determined. This angle is defined by a horizontal line through the curved column stitch origin and a radial line from the curved column stitch origin to the mid point of the initial stitch.

After determining delta r, delta theta, the angle theta$_0$, and the angle alpha for the required stitch, the rotation formulas set forth in FIG. 10*f* can be used. The point $(x_{on}, y_{on})$ represents the nth delta stitch point between the given character stitch points and which is located on the outer curve. By way of example, to determine the delta stitch point $(x_{o1}, y_{o1})$, the angle alpha$_1$ is determined after finding the angle alpha$_0$ and angle alpha$_f$. The angle theta$_1$ can be found using the previously determined delta theta and theta$_0$. Delta $r_1$ is found by combining delta $r_o$ and the change in the radial distance between the outer and mid curves in moving from the initial stitch to the next stitch, which is located between the points $(x_{i0}, y_{i0})$ to $(x_{o1}, y_{o1})$, see step delta $r_n$=delta $r_{n-1}$+delta distance/stitch/2 of FIG. 10*f*. In this example, the initial stitch is provided from the outer curve to the inner curve but it is readily appreciated that the initial stitch could be provided in the opposite direction. From the values of delta $r_1$, delta theta, theta$_0$, and alpha$_1$, the magnitudes of the x and y coordinate values for the first delta stitch point $(x_{o1}, y_{o1})$ can be found with reference to a coordinate system having an origin at the point $(x_{m1}, y_{m1})$. The x, y coordinate values of the point $(x_{m1}, y_{m1})$ are determined with reference to the curved column stitch origin $(x_c, y_c)$ in the same manner as discussed with respect to FIGS. 10*c* and 10*d*. The determined coordinate values $(x_{o1}, y_{o1})$ are then redefined having a magnitude with reference to the curved column stitch origin $(x_c, y_c)$. In stitching along a desired arc, the magnitude of the coordinates $(x_{o1}, y_{o1})$ are then defined with reference to the Arc Origin, using the unnormalized value of $(x_{m0}, y_{m0})$ and the coordinate values of $(x_c, y_c)$.

After determining the first delta stitch point on the outer curve, the first delta stitch point on the inner curve $(x_{i1}, y_{i1})$ can be found by rotating the first delta stitch point on the outer curve $(x_{o1}, y_{o1})$ 180° about the mid point $(x_{m1}, y_{m1})$. In order to determine succeeding delta stitch points on the outer and inner curves the foregoing process is continued until the final stitch point is reached. As a result, absolute x,y coordinate values of the character stitch points and delta stitch points can be determined for the curved stitch column. From these absolute values, the magnitudes of change between succeeding stitch points can be found. Using the magnitudes of change in the x and y directions, the x-stepping motor 22 and y-stepping motor 24 can be properly activiated through microprocessor 16 control to move the carriage assembly 32 to each stitch point along the outer and inner curves.

ROTATING STITCH POINTS

In order to stitch along an arc, the character stitch points stored in the character memory 52 are rotated to provide rotated x, y character stitch points. The delta stitch points between the rotated character stitch points are found as previously discussed using these rotated character stitch points. Depending upon the magnitude of the desired arc having the inputted radius along which letters are to be stitched, the letters selected by the operator or user, the direction of stitching, the magnitude of the center angle, and the letter style and height, stitch points having x and y coordinates of a rotated or second orientation, different than the first or reference orientation as stored in the character memory 52, are determined by the microprocessor 16 using the steps of FIG. 11*f*. That is to say, the reference orientations of character stitch points stored in the character memory 52 are modified in accordance with the stitch pattern desired by the operator.

In re-orientating the selected letters from a reference position having given or predetermined x, y coordinates to a rotated position, having rotated and determined x, y coordinates, each letter is initially characterized by a letter envelope having defined parameters. A letter envelope and character stitch points for a letter A are illustrated in FIG. 11*a*. Four stitch columns comprise the letter A. The letter envelope parameters Wt, Ht, HT, HB, W1, W2, W0 are also defined in FIG. 11*a*. These parameters are determined for each of the selected letters using the character stitch points stored in the character memory 52 and the letter height inputted to the microprocessor 16 by the operator. The determination of these parameters for each letter is accomplished using a routine stored in the EPROM 42. Basically, the routine checks each of the character stitch points to determine the maxima and minima x and y coordinates of the character stitch points of each letter by comparing the character stitch points with each other. Using these maxima and minima x and y coordinates, the character envelope parameters can be calculated. In addition, the distance W2 of the character or letter envelope can be found by the microprocessor 16 using a character envelope point stored in the character memory 52. The microprocessor 16 recognizes the character envelope point by a function or op code of nine, which accompanies the x and y coordinate values. When this op code is found, the microprocessor 16 initiates movement of the threaded needle 34 out of the fabric or material being stitched so that the carriage assembly 32 moves the fabric to the character envelope point.

Figure 11C:
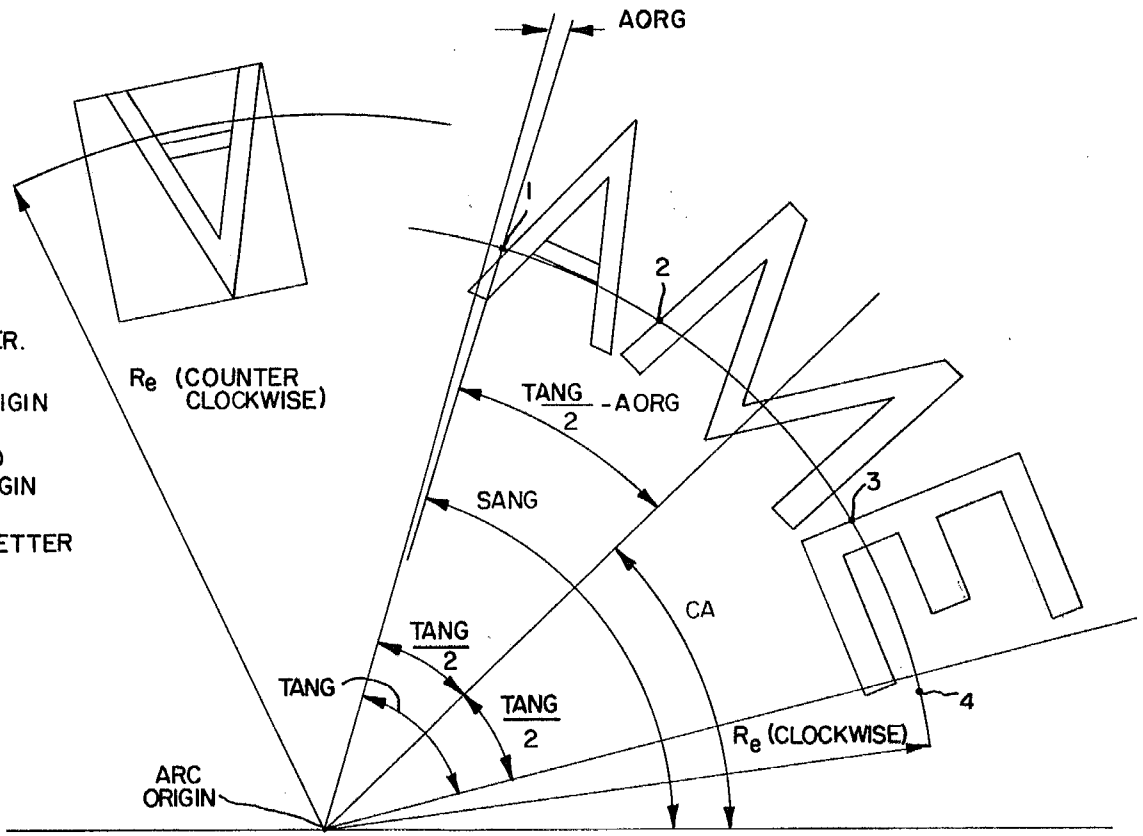
Figure 11F:
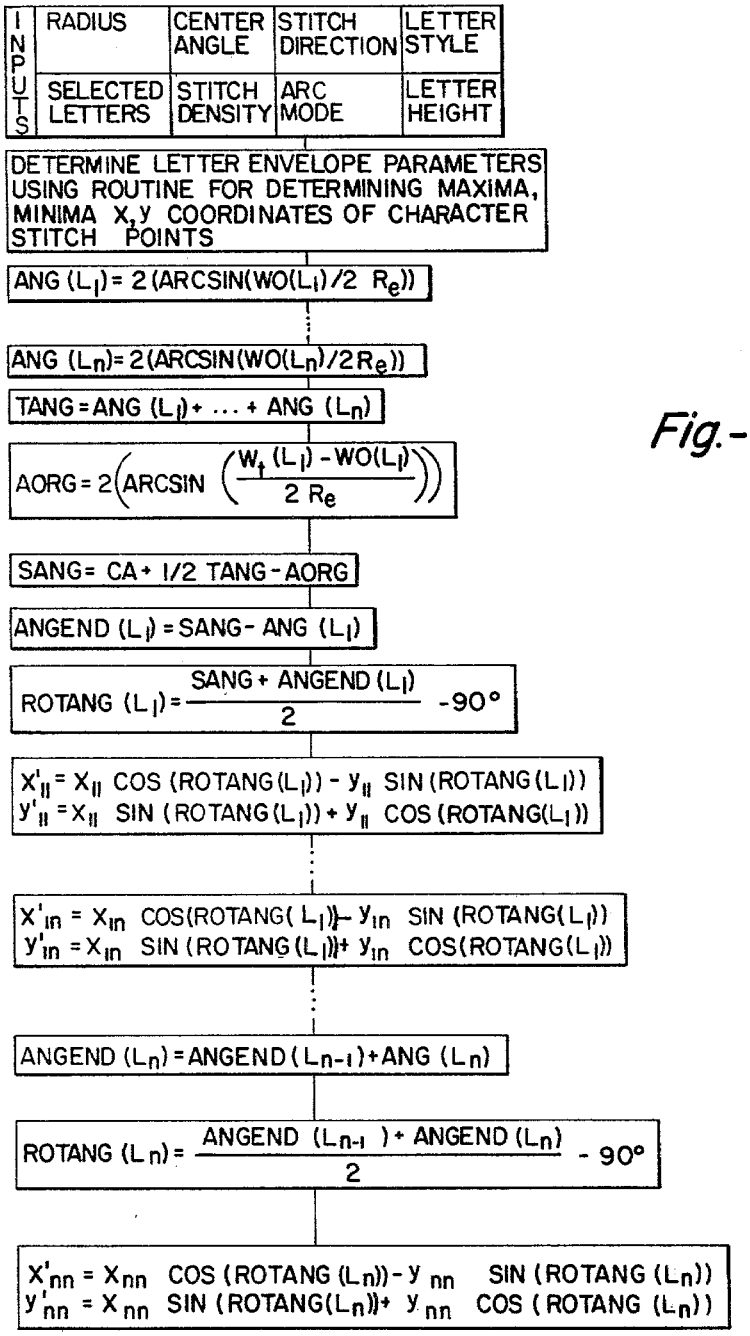

After obtaining each of the letter parameters for each of the letters selected by the operator to be stitched along the arc having the inputted radius R, the steps outlined in FIG. 11*f* are implemented by the microprocessor 16. The angles subtended by the envelope of each selected letter, ANG($L_1$)–ANG($L_n$), where $L_n$ indicates the nth letter selected, are determined using WO and $R_e$ as indicated in FIG. 11*b*. $R_e$=the radius inputted by the user combined with the distance HB from the Letter Origin to the base of the letter envelope. The distance HB is constant for any given letter style and is chosen by the letter designer.

After determining the angles $ANG(L_1)$–$ANG(L_n)$ subtended by the envelopes of the selected letters, the total angle subtended by all of the selected letter envelopes is then calculated and is defined as TANG.

With respect to the first letter stitched along the desired arc, WO=WT since the envelope portion to the left of the Letter Origin is included in the arc angle of the first letter, as represented by the letter A of FIG. 11*b*. With respect to the last letter stitched along the desired arc, WO=WO−W2 since the envelope portion to the right of the last letter stitched is not considered in determining the arc angle of the last letter.

With reference to FIG. 11*c*, the starting angle SANG of the first letter to be stitched is next determined. In this regard, the angle AORG, which is formed between the left edge of the first letter envelope and the Letter Origin, is found. The angle SANG is defined by a radial line through the first Letter Origin and a horizontal line through the Arc Origin. As previously noted, the Arc Origin is the initial starting point from which the material to be stitched is moved. The Arc Origin is selected by the operator by moving the material to be stitched to a desired location relative to the threaded needle 34 before stitching is initiated. The angle SANG is a function of the inputted center angle CA, the total arc length TANG, and the angle AORG as illustrated in FIG. 11*f*. The steps of FIG. 11*f* are used for stitching material along an arc in a clockwise direction. To stitch in a counterclockwise direction, the angle SANG=CA−½ TANG+AORG.

After the starting angle SANG of the first letter is found, the microprocessor is able to determine the origin angle of each letter. The origin angle=SANG for the first letter to be stitched. For subsequent letters to be stitched, the origin angle is the end angle of the preceding letter. By way of example, for stitching in a clockwise direction, the origin angle ANGORG of a third letter to be stitched=ANGEND ($L_2$) (end angle of second letter)=ANGEND ($L_1$) (end angle of first letter)+$ANG(L_2)$ (angle subtended by the second letter), where clockwise movement is negative.

Based on the starting angle SANG or the origin angles ANGORG of each letter, the ROTANG angle of each letter can be determined. The ROTANG angle represents the magnitude or degree of orientation change or rotation of each of the selected letters with respect to the first or reference position as defined by the magnitudes of the x, y coordinates of the character stitch points stored in the character memory 52 with reference to the Letter Origin. The ROTANG angle of each letter is determined for stitching in a clockwise direction by summing the origin angle and the end angle of the letter to be stitched, dividing that result by a factor of two, and subtracting 90° from that result. For stitching in a counterclockwise direction, 90° is added to the previously arrived at sum and division.

In rotating x, y coordinates of the character stitch points of the selected letter stored in the character memory 52, each character stitch point of each letter is rotated or modified. Microprocessor 16 determines the stitch pattern to be stitched, e.g., a straight or curved line of stitches or a straight or curved column of stitches, using the function or op codes accompanying the character stitch points. Once a stitch pattern corresponding to a portion of a letter is recognized by the microprocessor 16, the rotated x, y coordinates of the character stitch points are determined. The delta stitch points between the character stitch points can be found using the rotated character stitch points, as previously discussed.

With reference to FIG. 11*e*, the nth non-rotated character stitch point of the nth selected letter is represented by the coordinates ($x_{nn}$, $y_{nn}$). The rotated nth character stitch point of the nth selected letter is represented by the coordinates ($x'_{nn}$, $y'_{nn}$). Using the steps of FIG. 11*f*, each rotated stitch point can be found for the stitch pattern then being accessed from the character memory 52. In particular, for the nth selected letter $L_n$ to be stitched, the ROTANG angle thereof=$(ANGEND(L_{n-1})+ANGEND(L_n))/2-90°$ (clockwise stitching direction). To determine the rotated character stitch point ($x'_{nn}$, $y'_{nn}$) the rotation formulas set forth in FIG. 11*f* are used. The rotated stitch point is a function of the cosine and sine of the ROTANG angle of the letter then being stitched. The rotated character stitch point is also a function of the magnitude of the non-rotated character stitch point. Based on the given character stitch point and the ROTANG angle, each rotated character stitch point can then be found. The understanding of the derivations of these rotation formulas can be ascertained from analytic geometry treatises, e.g., see pages 587–588 of "*The Calculus With Analytic Geometry*" by Louis Liethold, published in 1968 and having a Library of Congress card number 67-12547. With respect to the rotation formulas set forth in FIGS. 10*d* and 10*f* for use in stitching portions of characters, the y term of the rotation formula of FIG. 11*f* is set equal to zero and the x term of the formula of FIG. 11*f* is set equal to the radius r.

In summarizing the steps for stitching letters along an arc having an Arc Origin and radius R provided by the operator, the following is provided:

1. Select the letters to be stitched, the radius of the arc along which the selected letters are to be stitched, the center angle of the arc, the stitch density, the direction of stitching, the height of the letters to be stitched, the style of the selected letters, and the mode of stitching;
2. Determine the (x,y) character stitch points of the selected letters with reference to their respective letter origins using the values of (x,y) character stitch points stored in the character memory;
3. Determine the envelope parameters for each of the selected letters using the maxima, minima program routine;
4. Determine the magnitude of the arc angle subtended for each of the selected letters and the effective radius $R_e$ using the letter style input;
5. Determine the angles AORG and SANG;
6. Determine the angle ROTANG for the first selected letter to be stitched;
7. Obtain the character stitch points of the first stitch pattern (straight line, curved line (arc), straight column, or curved column) of the first letter to be stitched using the operation codes accompanying the character stitch points;
8. Determine the rotated character stitch points of the first stitch pattern of the first letter with reference to the Letter Origin using the angle ROTANG and the x,y coordinates values of the character stitch points and then redefine the rotated character stitch points with reference to the Arc Origin;
9. Determine all of the delta stitch points with reference to the Arc Origin between the rotated character stitch points of the first stitch pattern of the first selected letter;

10. Determine the delta or change in magnitude in the x and y directions between succeeding character and delta stitch points or between succeeding delta stitch points for the first stitch pattern of the first selected letter;

11. Move the carriage assembly based on the determined magnitude of change in the x and y directions to position the carriage assembly beneath the threaded needle in order to stitch the first stitch pattern of the first selected letter along the desired arc;

12. Continue with obtaining all of the stitch patterns of the first letter using the character stitch points and accompanying operation codes and complete stitching of the first letter as with the first stitch pattern using the above defined steps 7–11;

13. Determine the angle ROTANG for each of the selected letters and continue with the above defined steps 7–12 for stitching the remaining selected letters along the desired arc.

In addition to the foregoing detailed discussion of the steps required to implement the stitching of selected characters along a desired arc, pertinent program instructions or software stored in the EPROM are also provided in a microfiche copy filed with this application and identified as the microfiche appendix. The microfiche appendix includes the program instructions for determining the x, y coordinates of the center of a circle and the radius of the circle using three given points, for determining delta stitch points using character stitch points, for determining character envelopes in order to obtain the required parameters of FIG. 11*a*, and for determining rotated or changed in orientation character stitch points.

Although the present invention has been described in connection with the stitching of characters along an arc, it is understood that stitching characters along any defined curve can be provided, including, for example, ellipses and portions thereof. It is necessary that a relationship be established between the reference orientation of the characters stored in memory and the desired and defined curve so that stitch points stored in memory can be changed for stitching along the defined curve.

From the foregoing description, it is readily appreciated that an apparatus and a method have been devised for rotating or changing the orientation of characters, including letters, from a first or reference orientation, defined by the x, y coordinates of character stitch points which are stored in memory, to a second orientation. The second orientation of stitch points is converted to stop signals outputted by the microprocessor to the power supplies of stepping motors. Through energization of the stepping motors, fabric or other material is moved between stitch points to desired locations for stitching along a determined arc. The user of the apparatus is not limited to one or more predetermined patterns of characters or letters stored in memory. The user is able to select any number of characters and change the orientation of character stitch points to various orientations utilizing a desired radius inputted by the user. As a consequence, considerable flexibility in the sewing and embroidery art is achieved while minimizing user intervention and error. Moreover, significant operator expense and time is reduced since new predetermined stitch patterns need not be developed and stored in computer memory in order to form different and desired stitch patterns along an arc.

Although the present invention has been described with reference to a particular embodiment thereof, it is readily appreciated that various modifications can be effected within the spirit and scope of this invention.

What is claimed is:

1. A method of stitching material along a curve using digital circuitry and memory means, comprising the steps of:

positioning the material to be stitched in a desired location relative to a threaded needle;

selecting one or more characters to be stitched along the curve from the memory means, all of the selected characters to be stitched being defined having a plurality of points in the memory means;

providing a magnitude of curvature of the curve along which each selected character is to be stitched;

determining the magnitude of an angle for each of the selected characters to be stitched, the magnitude of each angle of each selected character to be stitched determined using the magnitude of curvature;

sensing the position of the needle with respect to the material;

moving the material or the needle to determined locations when the needle is out of the material based upon a determination of stitch locations using each determined angle in order to stitch each selected character along the curve; and stitching the material at the determined locations when the needle is in the material so that each selected character is stitched along the curve.

2. A method, as claimed in claim 1, wherein:

the magnitude of curvature includes a radius and the curve is a circular arc and in which each of the characters in the memory means has a width and each of the widths being defined independent of the provided radius.

3. A method of stitching material along a curve using digital circuitry and memory means, comprising the steps of:

positioning the material to be stitched in a desired location relative to a threaded needle;

selecting sequentially one or more characters to be stitched, all of the characters to be stitched being defined in memory means according to a first orientation;

providing a magnitude of curvature;

changing the characters from a first orientation to a second orientation using the magnitude of curvature, the magnitude of change of orientation of each selected character to be stitched depending upon all of the selected characters to be stitched and the magnitude of change of orientation of each selected character to be stitched depending upon the sequence of selection of characters to be stitched;

stitching the material using the threaded needle so that the selected characters are stitched according to the second orientation.

4. A method for stitching material along a curve using digital circuitry and memory means, comprising the steps of:

positioning the material to be stitched in a desired location relative to a threaded needle;

providing a radius;

selecting characters to be stitched from a plurality of characters stored in the memory means, each of the characters having a plurality of points, each of the characters having a character envelope being defined by at least a height and a width using at least some of the plurality of points, the height and width being defined independent of the provided radius;

obtaining a portion of one of the characters;

changing the orientation of the character portion using the radius and at least the width of the character envelope of the character whose portion was obtained;

moving a carriage to which the material is connected to a location depending upon the changed in orientation character portion;

stitching the changed in orientation character portion on the material.

5. An apparatus for use in stitching characters on material along a curve, comprising:

first means for storing a plurality of characters, each of said characters being defined by a plurality of points, each of said points being defined by at least two coordinates, at least two of said coordinates of each of said characters for use in defining a character width;

input means for use in providing a magnitude of curvature;

second means communicating with said first means and said input means for changing the magnitude of at least one of said coordinates of one of said points of one of said characters, said second means including means for determining an angle associated with said one of said characters using the magnitude of curvature and the character width of said one of said characters, the determined angles being used in changing the magnitude of said one of said coordinates;

third means responsive to said second means for stitching at least one of said characters along the curve using said changed magnitude of said one of said coordinates.

6. An apparatus as claimed in claim 5, wherein said third means includes:

means for moving the material with respect to the threaded needle, said means for moving includes at least a first stepping motor and a second stepping motor, said first stepping motor being activated to move the material in a first direction and said second stepping motor being activated to move the material in a second direction.

7. An apparatus for stitching characters on material along a curve using a threaded needle, comprising:

means for storing a plurality of characters, each of said characters being defined by at least one point having a first coordinate and a second coordinate;

means for inputting sequentially selected characters and for inputting a magnitude of curvature of the curve along which the selected characters are to be stitched;

means responsive to said inputting means for selecting said selected characters from said storing means, each of said selected characters having a width;

means communicating with said storing means for changing in magnitude said first coordinate and said second coordinate of said one point using said magnitude of curvature, the magnitude of change of said first coordinate and said second coordinate depending upon the widths of all selected characters and the sequence of selection of said selected characters and the determination of the magnitude of change of said first coordinate and said second coordinate being different than the determination of the magnitude of change of coordinates of any other selected character;

means responsive to said rotating means for moving the material using said changed in magnitude first coordinate and said changed in magnitude second coordinate; and means communicating with said changing means for sensing the position of the threaded needle with respect to the material to be stitched.

* * * * *

UNITED STATES PATENT AND TRADEMARK OFFICE

CERTIFICATE OF CORRECTION

PATENT NO. : 4,352,334

DATED : October 5, 1982

INVENTOR(S) : Childs, et al.

It is certified that error appears in the above—identified patent and that said Letters Patent is hereby corrected as shown below:

At column 19, line 31, delete "angles" and substitute therefore -- angle--.

At column 20, at line 30, delete "than" and substitute therefore -- from --; at line 32, delete "rotating" and substitute therefore -- changing --.

Signed and Sealed this

*Twenty-second* Day of *October 1985*

[SEAL]

*Attest:*

DONALD J. QUIGG

*Attesting Officer*

*Commissioner of Patents and Trademarks—Designate*